US007611137B2

(12) United States Patent
Chu et al.

(10) Patent No.: US 7,611,137 B2
(45) Date of Patent: Nov. 3, 2009

(54) AUTOMATIC DOCUMENT FEEDER

(75) Inventors: Te-Yu Chu, Hsinchu (TW); Yueh-Shing Lee, Hsinchu (TW); Wen-Sheng Liu, Hsinchu (TW)

(73) Assignee: Foxlink Image Technology Co., Ltd., Hsinchu (TW)

( * ) Notice: Subject to any disclaimer, the term of this patent is extended or adjusted under 35 U.S.C. 154(b) by 92 days.

(21) Appl. No.: 11/935,999

(22) Filed: Nov. 6, 2007

(65) Prior Publication Data

US 2009/0115128 A1 May 7, 2009

(51) Int. Cl.
*B65H 5/22* (2006.01)

(52) U.S. Cl. ..... 271/3.2; 271/3.21; 271/4.04

(58) Field of Classification Search ..... 271/3.2, 271/3.21, 4.04
See application file for complete search history.

(56) References Cited

U.S. PATENT DOCUMENTS 3,218,060 A * 11/1965 Harbison ..... 271/4.04
4,787,311 A * 11/1988 Mol ..... 101/232
4,991,828 A * 2/1991 Mizoguchi ..... 271/3.2
5,676,362 A * 10/1997 Ferraris ..... 271/3.14
5,794,927 A * 8/1998 Uchida ..... 271/3.18
6,007,063 A * 12/1999 Park ..... 271/273
6,027,109 A * 2/2000 Wada et al. ..... 271/3.14
6,978,991 B2 * 12/2005 Stevens et al. ..... 271/3.2
2001/0024010 A1 * 9/2001 Andersson et al. ..... 271/4.09

* cited by examiner

*Primary Examiner*—David H Bollinger
(74) *Attorney, Agent, or Firm*—WPAT, P.C.; Anthony King; Kay Yang

(57) ABSTRACT

An automatic document feeder includes a main body defining a passage for transporting a document. A feeding roller unit includes a feeding driving roller and a feeding idle roller coupling with the feeding driving roller. The feeding driving roller and the feeding idle roller are disposed at opposite sides of the passage. A drawing-out roller unit includes a drawing-out driving roller and a drawing-out idle roller coupling with the drawing-out driving roller. The drawing-out driving roller and the drawing-out idle roller are disposed at opposite sides of the passage. The drawing-out driving roller and the feeding driving roller are at the same side of the passage. And a belt is put around the feeding driving roller and the drawing-out driving roller to mate with the feeding idle roller and the drawing-out idle roller respectively for flatting and conveying the document into and out of the automatic document feeder.

7 Claims, 5 Drawing Sheets

AUTOMATIC DOCUMENT FEEDER

BACKGROUND OF THE INVENTION

1. Field of the Invention

The present invention relates to an automatic document feeder mounted in an office machine, such as a fax machine, a scanner, a printer, a copy machine, or a multi-function peripheral (MFP), etc. to convey a document into or out of the office machine.

2. The Related Art

An automatic document feeder is widely used in an office machine, such as a fax machine, a scanner, a printer, a copy machine, or a multi-function peripheral (MFP), etc. The automatic document feeder conveys a document into the office machine to have an image handled, and then, the automatic document feeder transports the handled document to the outside of the office machine.

Referring to FIG. 1 providing a conventional automatic document feeder 200, the automatic document feeder 200 includes a feeding roller unit 70, a drawing-out roller unit 80 and a document-feeding passage 90. After the document enters the document-feeding passage 90, the feeding roller unit 70 including a feeding driving roller 71 and a feeding idle roller 72 gearing the feeding driving roller 71 feeds the document to an image-handling unit to have an image handled. Then, the drawing-out roller unit 80 involving a drawing-out driving roller 81 and a drawing-out idle roller 82 gearing the drawing-out driving roller 81 delivers the handled document to the outside of the document-feeding passage 90. Because the automatic document feeder 200 has the feeding roller unit 70 and the drawing-out roller unit 80, two pairs of gear wheels which are driven by a power machine such as a motor (not shown) are needed to mate with the feeding roller unit 70 and the drawing-out roller unit 80 respectively for carrying the document forward. Therefore, the structure of the automatic document feeder 200 is rather complex, and what is more, the manufacture cost and the difficulty of fabricating the automatic document feeder 200 are increased.

Referring to FIG. 2 representing an improved automatic document feeder 300, the automatic document feeder 300 has a document-transporting roller 100 instead of the feeding driving roller 71 and the drawing-out driving roller 81 (shown in FIG. 1). The document-transporting roller 100 gears a feeding idle roller 73 to feed the document to an image-handling unit to have an image handled. And at the same time the document-transporting roller 100 gears a drawing-out idle roller 83 to deliver the handled document to the outside of a document-feeding passage 91. Although the automatic document feeder 300 needs a pair of gear wheels driven by a power machine such as a motor (not shown) to mating with the document-transporting roller 100, simplifying the structure of the automatic document feeder 300 and reducing the manufacture cost thereof, however, the automatic document feeder 300 has only one document-transporting roller 100 to gear the feeding idle roller 73 and the drawing-out idle roller 83 simultaneously, increasing a drawing-out angle of the document, and then, the document is drawn out of the document-feeding passage 91 not smoothly.

SUMMARY OF THE INVENTION

Accordingly, an object of the present invention is to provide an automatic document feeder mounted in an office machine for conveying a document into or out of the office machine. The automatic document feeder includes a main body defining a passage for transporting the document. A feeding roller unit includes a feeding driving roller and a feeding idle roller coupling with the feeding driving roller. The feeding driving roller and the feeding idle roller are disposed at opposite sides of the passage. A drawing-out roller unit includes a drawing-out driving roller and a drawing-out idle roller coupling with the drawing-out driving roller. The drawing-out driving roller and the drawing-out idle roller are disposed at opposite sides of the passage. The drawing-out driving roller and the feeding driving roller are at the same side of the passage. And a belt is put around the feeding driving roller and the drawing-out driving roller to mate with the feeding idle roller and the drawing-out idle roller respectively for flatting and conveying the document into and out of the automatic document feeder. Wherein the belt is set only to surround the feeding roller unit and the drawing-out roller unit.

As described above, because the belt is put around the feeding driving roller and the drawing-out driving roller, the automatic document feeder utilizes one pair of gear wheels to drive the feeding roller unit and the drawing-out roller unit rotating simultaneously, and at the same time, the belt flats the document, which ensures that the document is fed and transported out of the automatic document feeder smoothly. It is obvious that the automatic document feeder has a simply structure and it is easy to fabricate the automatic document feeder. Therefore, the manufacture cost of the automatic document feeder is reduced.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENTS

Figure 1:
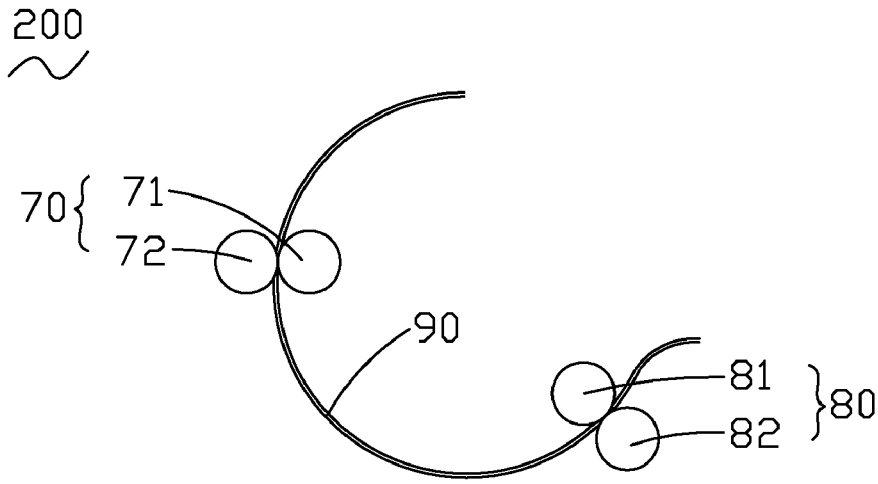
FIG. 1 Prior Art
FIG. 1 is a side view of a prior automatic document feeder.
Figure 2:
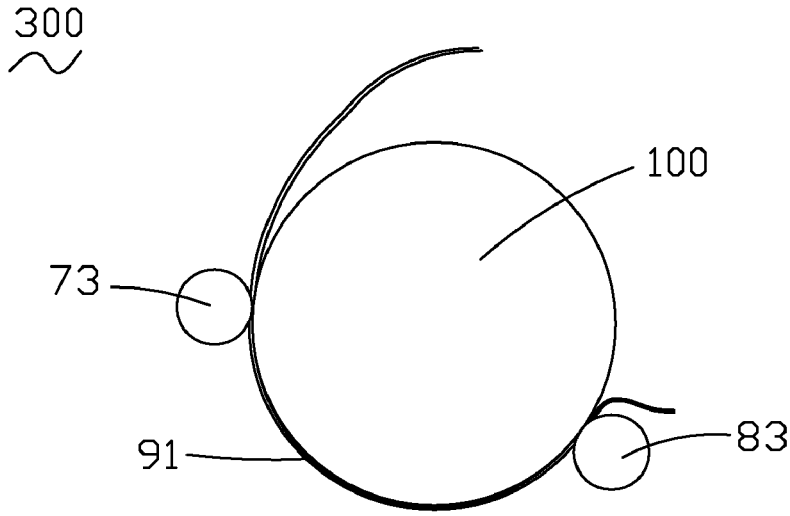
FIG. 2 Prior Art
FIG. 2 is a side view of another prior automatic document feeder.
Figure 3:
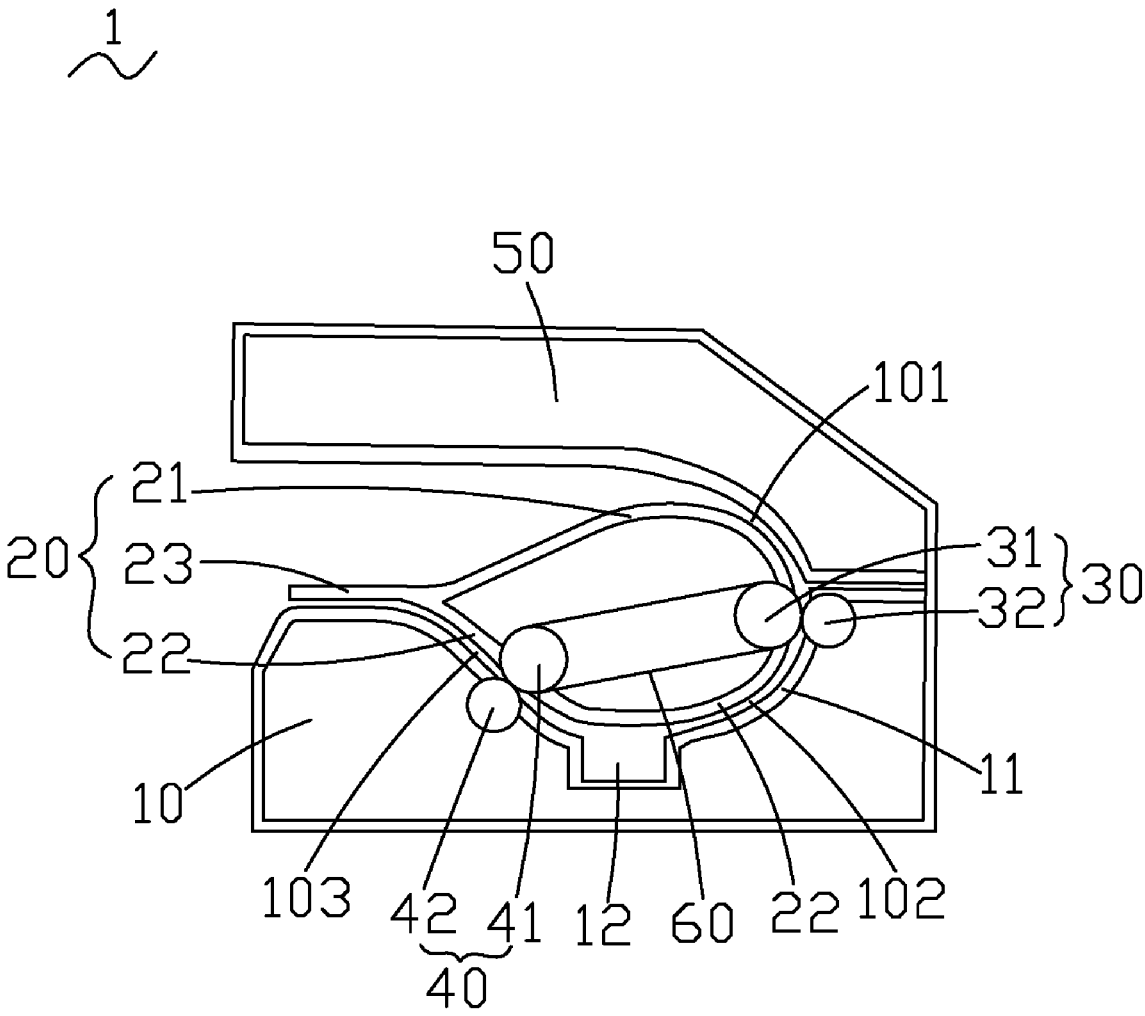
FIG. 3 is a side view of an automatic document feeder in accordance with a first embodiment of the present invention.

Referring to FIG. 3, an automatic document feeder 1 in accordance with a first embodiment of the present invention includes a pedestal 10, a document-guiding element 20, a feeding roller unit 30, a drawing-out roller unit 40 and a cover 50. The cover 50 couples with the pedestal 10, and thereby, an accommodating chamber is formed between the cover 50 and the pedestal 10. The document-guiding element 20, the feeding roller unit 30 and the drawing-out roller unit 40 are received in the accommodating chamber. The pedestal 10 defines a concave supporting-surface 11 extending from a front end to a substantial rear end thereof. The supporting-surface 11 opens a hollow recess 12 at substantially the center thereof. An image-handling unit (not shown) is seated in the recess 12.

The document-guiding element 20 in a horizontally lied sealed Y-shape has a loading portion 21 and a transporting portion 22. The junction of the loading portion 21 and the transporting portion 22 extends outward to form a leading portion 23. A passage that a document passes through is formed between the document-guiding element 20, the pedestal 10 and the cover 50, which includes an entering passage 101 formed between the loading portion 21 and the cover 50. An operating passage 102 is formed between the rear of the transporting portion 22 and the rear of the supporting-surface 11 of the pedestal 10. An exiting passage 103 is formed between the front of the transporting portion 22, the leading portion 23 and the front of the supporting-surface 11 of the pedestal 10.

The feeding roller unit 30 has a feeding driving roller 31 and a feeding idle roller 32. The feeding driving roller 31 is disposed at the document-guiding element 20 and near to the entering passage 101. The feeding idle roller 32 coupling with the feeding driving roller 31 is disposed at a side of the entering passage 101 opposite to the feeding driving roller 31. The drawing-out roller unit 40 has a drawing-out driving roller 41 and a drawing-out idle roller 42. The drawing-out driving roller 41 is disposed at the document-guiding element 20 and near to the exiting passage 103. The drawing-out idle roller 42 coupling with the drawing-out driving roller 41 is disposed at a side of the exiting passage 103 opposite to drawing-out driving roller 41. The drawing-out driving roller 41 and the feeding driving roller 31 are at the same side of the passage. A belt 60 is put around the feeding driving roller 31 and the drawing-out driving roller 41 and then mates with the feeding idle roller 32 and the drawing-out idle roller 42 respectively to bring the feeding roller unit 30 and the drawing-out roller unit 40 to rotate at the same time.

Figure 4:
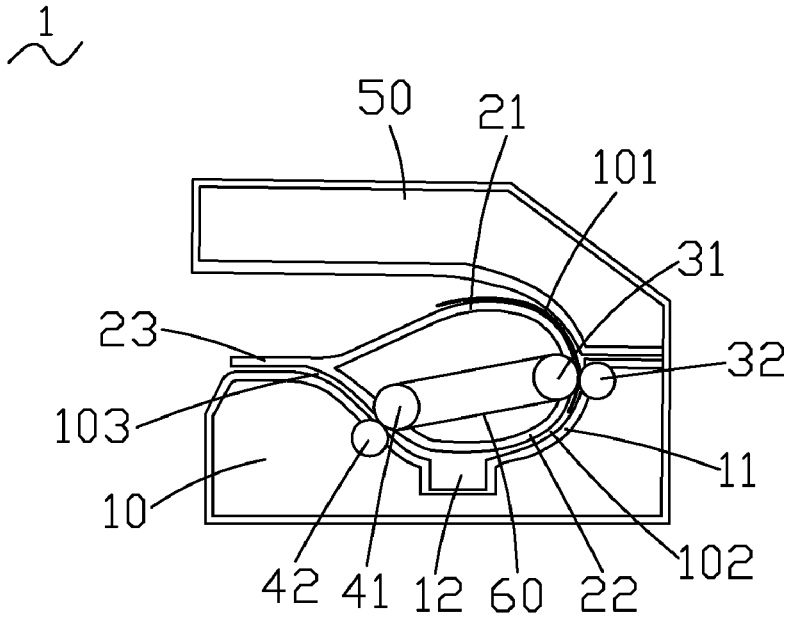
FIGS. 4-7 are side views showing processes of the automatic document feeder feeding and drawing out a document.

Please refer to FIGS. 4-7 showing processes of the automatic document feeder 1 feeding and drawing out the document. The processes are described as follows:

With reference to FIG. 4, a picking-up device (not shown) is provided to pick up the document stacked in a document-supplying tray (not shown) and then the document enters the entering passage 101 and is placed between the belt 60 and the feeding idle roller 32. Afterwards, a pair of gear wheels that is driven by a power machine such as a motor (not shown) is employed to drive the feeding driving roller 31 rotating in a direction. Then the feeding idle roller 32 is driven rotating by the feeding driving roller 31 in an opposite direction. Therefore, the document located between the belt 60 and the feeding idle roller 32 is flatted and conveyed to the operating passage 102.

Figure 5:
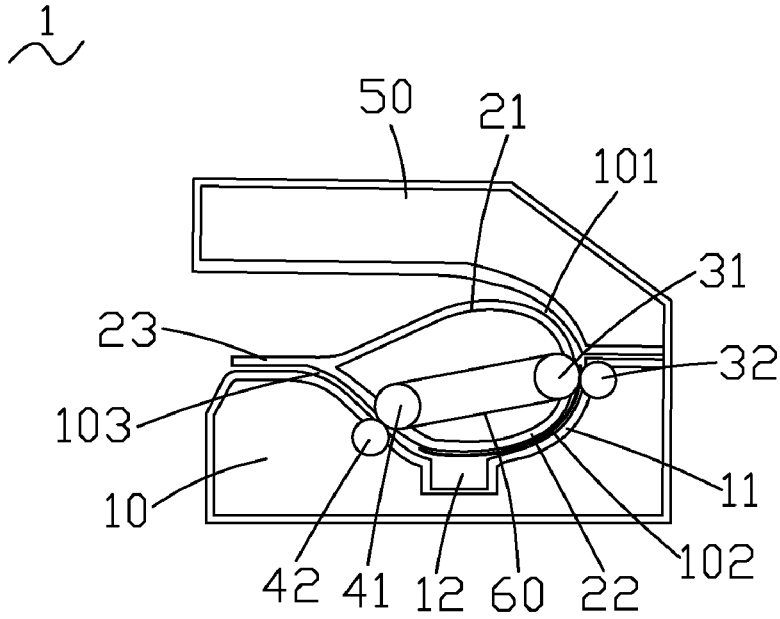

Referring to FIG. 5, the document is conveyed forward along the operating passage 102 by the belt 60 and the feeding idle roller 32. When the document is conveyed above the image-handling unit seated in the recess 12, the image-handling unit provides an image-handling operation to the document.

Figure 6:
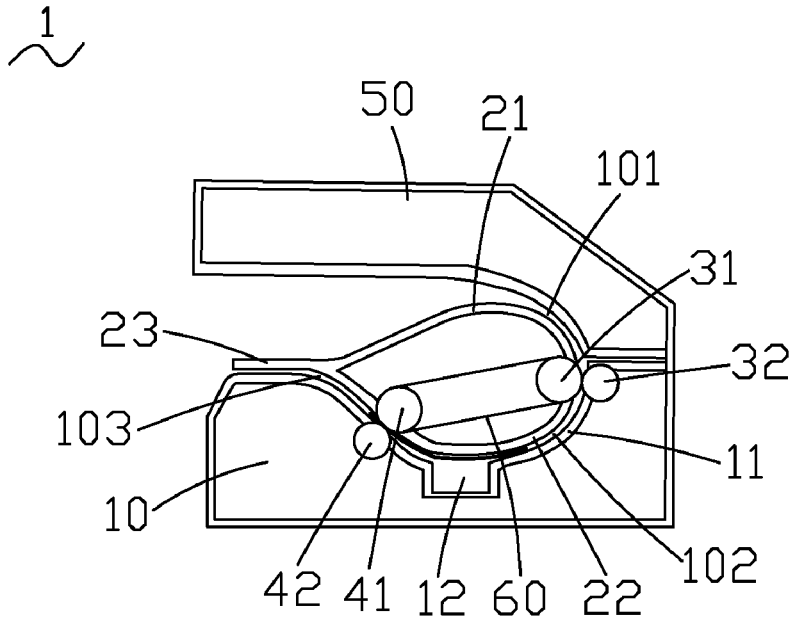
Figure 7:
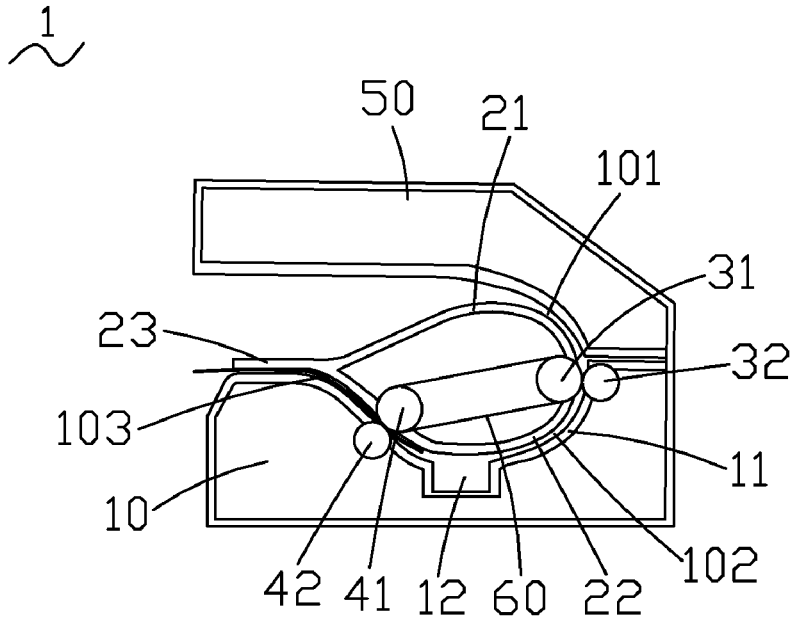

Referring to FIG. 6 and FIG. 7, after the document is handled by the image-handling unit, the document is transported forward and located between the drawing-out driving roller 41 and drawing-out idle roller 42. Then because the belt 60 is put around the feeding driving roller 31 and the drawing-out driving roller 41, which drives the drawing-out driving roller 41 rotating in the same direction as the feeding driving roller 31, the drawing-out idle roller 42 is driven rotating by the drawing-out driving roller 41 in the same direction as the feeding idle roller 32. Thereby, the document is transported to the exiting passage 103 and further transported to the outside of the automatic document feeder 1 under the pushing action of the belt 60 and the drawing-out idle roller 42.

Figure 8:
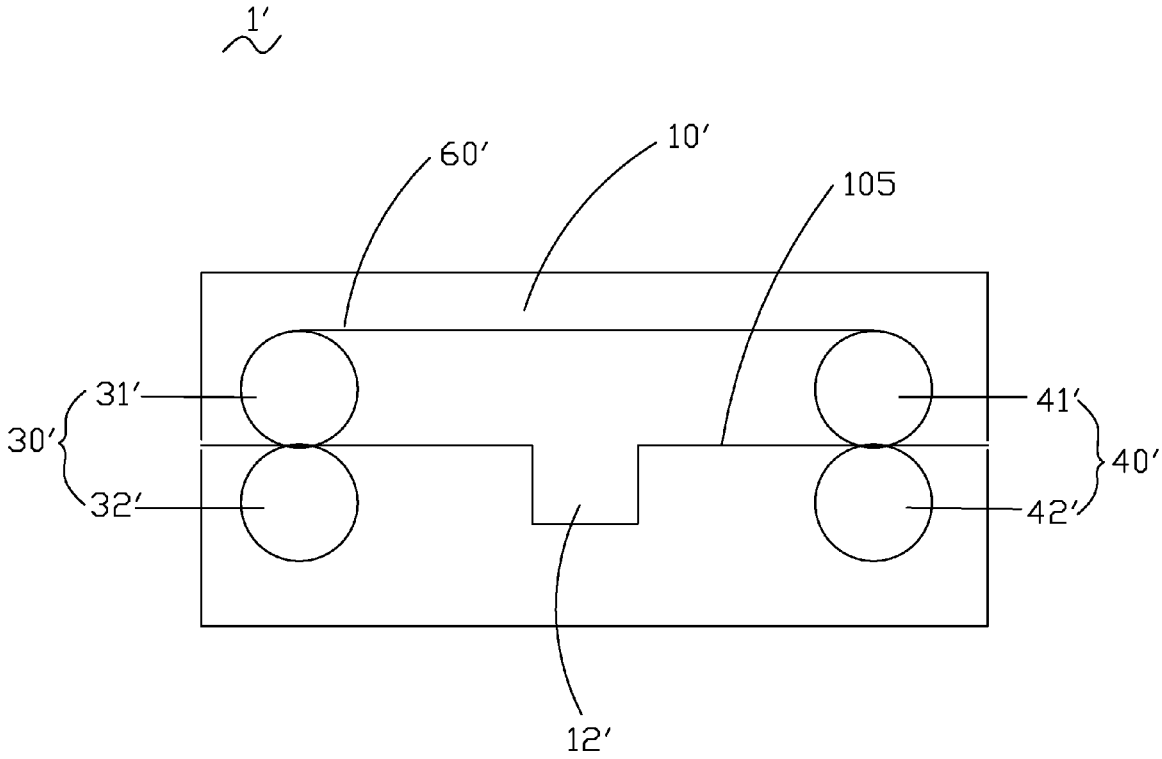
FIG. 8 is a side view of an automatic document feeder in accordance with a second embodiment of the present invention.

Please refer to FIG. 8. Another embodiment of the present invention provides an automatic document feeder 1' having a main body 10', a feeding roller unit 30' and a drawing-out roller unit 40'. The main body 10' defines a passage 105 for transporting a document and a hollow recess 12' at substantially the center thereof for receiving an image-handling unit (not shown). The feeding roller unit 30' and the drawing-out roller unit 40' are received in the main body 10'. The feeding roller unit 30' includes a feeding driving roller 31' and a feeding idle roller 32'. The feeding driving roller 31' is disposed at an upper side of the passage 105. The feeding idle roller 32' coupling with the feeding driving roller 31' is disposed at a lower side of the passage 105. The drawing-out roller unit 40' includes a drawing-out driving roller 41' and a drawing-out idle roller 42'. The drawing-out driving roller 41' is disposed at the upper side of the passage 105 and parallel with the feeding driving roller 31'. The drawing-out idle roller 42' coupling with the drawing-out driving roller 41' is disposed at the lower side of the passage 105 and parallel with the feeding idle roller 32'. A belt 60' is put around the feeding driving roller 31' and the drawing-out driving roller 41' and then mates with the feeding idle roller 32' and the drawing-out idle roller 42' respectively for flatting and conveying the document. The processes of the automatic document feeder 1' feeding and drawing out the document are as the same as the first embodiment of the present invention, which are not described any more.

As described above, because the belt 60 is put around the feeding driving roller 31 and the drawing-out driving roller 41, the automatic document feeder 1 utilizes one pair of gear wheels to drive the feeding roller unit 30 and the drawing-out roller unit 40 rotating simultaneously, and at the same time, the belt 60 flats the document, which ensures that the document is fed and transported out of the automatic document feeder 1 smoothly. It is obvious that the automatic document feeder 1 has a simply structure and it is easy to fabricate the automatic document feeder 1. Therefore, the manufacture cost of the automatic document feeder 1 is reduced.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An automatic document feeder, comprising:

a main body, having a pedestal and a cover coupling with the pedestal, a document-guiding element mounted between the pedestal and the cover, a passage formed between the document-guiding element and the pedestal and cover, which includes an entering passage, an operating passage and an exiting passage;

a feeding roller unit, including a feeding driving roller disposed at the document-guiding element and near to the entering passage, and a feeding idle roller coupling with the feeding driving roller disposed at a side of the entering passage opposite to the feeding driving roller;

a drawing-out roller unit, including a drawing-out driving roller disposed at the document-guiding element and near to the exiting passage, and a drawing-out idle roller coupling with the drawing-out driving roller disposed at a side of the exiting passage opposite to the drawing-out driving roller, the drawing-out driving roller and the feeding driving roller being at the same side of the passage; a belt around the feeding driving roller and the drawing-out driving roller to mate with the feeding idle roller and the drawing-out idle roller respectively for flatting and conveying a document into and out of the automatic document feeder wherein the belt is set only to surround the feeding roller unit and the drawing-out roller unit; and an image-handling unit disposed between the feeding roller unit and the drawing-out roller unit, wherein the pedestal defines a concave supporting-surface extending from a front end to a substantial rear end thereof, the supporting-surface opens a hollow recess at substantially the center thereof for receiving the image-handling unit.

2. The automatic document feeder as claimed in claim 1, wherein the document-guiding element has a loading portion and a transporting portion, the junction of the loading portion and the transporting portion extends outward to form a leading portion, the entering passage is formed between the loading portion and the cover, the operating passage is formed between the rear of the transporting portion and the rear of the pedestal, the exiting passage is formed between the front of the transporting portion, the leading portion and the front of the pedestal.

3. An automatic document feeder, comprising:

a main body, defining a passage for transporting a document;

a feeding roller unit, including a feeding driving roller and a feeding idle roller coupling with the feeding driving roller, the feeding driving roller and the feeding idle roller disposed at opposite sides of the passage;

a drawing-out roller unit, including a drawing-out driving roller and a drawing-out idle roller coupling with the drawing-out driving roller, the drawing-out driving roller and the drawing-out idle roller disposed at opposite sides of the passage, the drawing-out driving roller and the feeding driving roller being at the same side of the passage; and a belt set only to tightly surround the feeding roller unit and the drawing-out roller unit and contact with the feeding idle roller and the drawing-out idle roller for being driven to rotate and further drive the feeding idle roller and the drawing-out idle roller by means of a friction therebetween and then contacting and conveying the document into and out of the automatic document feeder by the cooperation of the feeding idle roller and the drawing-out idle roller.

4. An automatic document feeder, comprising:

a main body, having a pedestal and a cover coupling with the pedestal, a document-guiding element mounted between the pedestal and the cover, a passage formed between the document-guiding element and the pedestal and cover, which includes an entering passage, an operating passage and an exiting passage;

a feeding roller unit, including a feeding driving roller disposed at the document-guiding element and near to the entering passage, and a feeding idle roller coupling with the feeding driving roller disposed at a side of the entering passage opposite to the feeding driving roller;

a drawing-out roller unit, including a drawing-out driving roller disposed at the document-guiding element and near to the exiting passage, and a drawing-out idle roller coupling with the drawing-out driving roller disposed at a side of the exiting passage opposite to the drawing-out driving roller, the drawing-out driving roller and the feeding driving roller being at the same side of the passage; and a belt set only to tightly surround the feeding roller unit and the drawing-out roller unit and contact with the feeding idle roller and the drawing-out idle roller for being driven to rotate and further drive the feeding idle roller and the drawing-out idle roller by means of a friction therebetween and then contacting and conveying a document into and out of the automatic document feeder by the cooperation of the feeding idle roller and the drawing-out idle roller.

5. The automatic document feeder as claimed in claim 4, further comprising an image-handling unit disposed between the feeding roller unit and the drawing-out roller unit.

6. The automatic document feeder as claimed in claim 5, wherein the pedestal defines a supporting-surface extending from a front end to a substantial rear end thereof, the supporting-surface opens a cavity at substantially the center thereof for receiving the image-handling unit.

7. The automatic document feeder as claimed in claim 4, wherein the document-guiding element has a loading portion and a transporting portion, the junction of the loading portion and the transporting portion extends outward to form a leading portion, the entering passage is formed between the loading portion and the cover, the operating passage is formed between the rear of the transporting portion and the rear of the pedestal, the exiting passage is formed between the front of the transporting portion, the leading portion and the front of the pedestal.

* * * * *